United States Patent [19]

Coons

[11] Patent Number: 4,507,047

[45] Date of Patent: Mar. 26, 1985

[54] HOOP TURBINE

[75] Inventor: Terry L. Coons, Dayton, Ohio

[73] Assignee: Tech Development Inc., Dayton, Ohio

[21] Appl. No.: 470,089

[22] Filed: Feb. 28, 1983

[51] Int. Cl.[3] ..... F01D 21/00

[52] U.S. Cl. ..... 415/9; 416/2

[58] Field of Search ..... 415/9; 416/2

[56] References Cited

U.S. PATENT DOCUMENTS

| | | | |
|---|---|---|---|
| 2,962,257 | 11/1960 | Allingham | 415/9 |
| 2,987,296 | 6/1961 | Ferguson | 415/9 |
| 3,051,440 | 8/1962 | Chandler | 416/2 |
| 3,128,989 | 4/1964 | Allingham | 415/9 X |
| 3,158,999 | 12/1964 | Carriere et al. | 415/9 |

FOREIGN PATENT DOCUMENTS

| | | | |
|---|---|---|---|
| 629776 | 9/1949 | United Kingdom | 415/9 |
| 993711 | 6/1965 | United Kingdom | 415/9 |

*Primary Examiner*—Everette A. Powell, Jr.

*Attorney, Agent, or Firm*—Jerome P. Bloom

[57] ABSTRACT

As originally fabricated the rotor of the invention is a unitized structure an outer portion of which, including its outer peripheral surface, is designed to separate shortly after the start of its rotation. As illustrated, this outer peripheral portion is a ring-shaped structure which is initially incorporated by an interference fit which establishes it in a fixed bounding relation to the rotor part immediately inward thereof. At the point in time that said outer portion of the rotor is separated, guide means are rendered operative to maintain a drive coupling as between the outer and inward rotor parts and such guide means then serve as bearings accommodating the radial movement of the outer separated part in correspondence with its changing radius in response to changing speeds of rotation of the rotor. Any failure of the rotor is benign in that at such time the rotor exceeds the designed limit of its speed of rotation the outer part expands sufficient to brake against its adjacent shield or housing.

16 Claims, 6 Drawing Figures

HOOP TURBINE

BACKGROUND OF THE INVENTION

This invention relates to improvements in rotors, particularly turbine rotors.

A relatively recent invention subject of application for U.S. Letters Patent Ser. No. 353,615, filed Mar. 1, 1982 for TURBINE ROTOR, owned by Tech Development Inc. of Dayton, Ohio, has provided a new means and method to reasonably cope with and minimize a danger ever present in the use of turbine rotors. This danger stems from the fact that malfunction, inadvertent misoperation or negligence may produce a set of circumstances in response to which a rotor may be caused to rotate at an excessive, uncontrollable speed and develop such a high degree of centrifugal force as to stress the rotor to the point it will explosively fragment. The result may not only be damage to equipment but injury to personnel.

While testing and use of embodiments of the invention subject of the aforesaid application have proven its value and confirmed that it provides a significant contribution to the art, it does not provide a total solution to the problems that exist where the size and/or weight of the rotor is substantial. In the latter case the rotor is subjected to such a significant shock load and stress on starting as to produce early wear and fatigue of its structure, which affects and shortens its operating life. This is especially so when certain materials must be used in its fabrication. The present invention not only deals with this problem but also provides a substantially universally applicable solution to the problem first stated. Moreover, the present invention has wider scope of application and benefit than that made possible by the disclosure of application for U.S. Letters Patent Ser. No. 353,615.

As far as the inventor is concerned, the only prior art specifically pertinent to the novelty of the present invention is that disclosed in the aforesaid application for U.S. Letters Patent Ser. No. 353,615.

SUMMARY OF THE INVENTION

An embodiment of the present invention provides a rotor structure a radially inward part of which is bounded and circumferentially encompassed by a ring-shaped outer part. The rotor parts are connected so that the ring-shaped outer part remains fixed as to its position as the rotor is energized and for a brief period thereafter. The connection of the parts is such that when the rotor is energized and its speed of rotation rises to a prescribed level, not exceeding its operating speed, the outer part of the rotor is conditioned to break free from the radially inward part and thereafter expand and move in a direction radially outward thereof under the influence of the centrifugal force developed in correspondence with subsequent changes in the speed of rotation of the rotor. After the ring-shaped outer part of the rotor breaks free of its radially inward part, for so long as the speed of its rotation does not exceed its designed limit, the rotor parts remain coupled by guide means which insure their continuing conjoint rotation. The guide means provide that any movement of the ring-shaped outer part relative the inner part of the rotor is maintained in a plane substantially perpendicular to the rotor axis and balanced.

In the installation of the rotor its outer periphery will operate normally in an adjacent spaced relation to the inner wall surface of a shield or housing. The arrangement provides that at such time its speed of rotation exceeds its designed limit, the outer ring-shaped part of the rotor will be induced by the centrifugal force then developed to expand sufficiently to engage against and in braking relation to the inner wall surface of the shield or housing. The effect of this is to disable the rotor and in any case immediately interrupt or substantially reduce the speed of its rotation.

The embodiment and application of the present invention insures a benign failure of the rotor substantially irrespective of its size or weight. At the same time it also minimizes early stress, wear and fatigue, thereby to provide a rotor having an extended operating life, considering its size, weight and the materials of which it has been fabricated.

It is a primary object of the invention to provide a rotor, particularly a turbine rotor, which is economically fabricated, more efficient and satisfactory in use, adaptable to a wider variety of application and pre-controlled as to its function.

Another object is to provide an improved construction for a turbine rotor which substantially eliminates or minimizes, in correspondence with its size and/or weight, the normally anticipated shock load, wear and/or stress to which it is subjected at the time of its energization.

A further object of the invention is to provide an improved rotor the quality of which is such as to extend its useful operating life.

An additional object of the invention is to provide a construction for a turbine rotor which provides that upon starting of its rotation it is an integrated structure and that by the time it reaches its operating speed it has an outer ring-shaped part thereof radially separate from the rotor part inward thereof while remaining coupled thereto for their conjoint rotation to that point in time their speed of rotation exceeds the designed speed limit of the rotor, at which time the outer ring-shaped part is conditioned to engage in a braking relation to the rotor housing or shield.

A further object of the invention is to provide a rotor, particularly a turbine rotor, designed to have a predictable and relatively benign manner of failure, should such occur, possessing the advantageous structural features, and inherent meritorious characteristics and the means and method of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalent.

Referring to the drawings wherein only one but not necessarily the only form of embodiment of the invention is illustrated, FIG. 1 is a schematic view of an integrated turbine rotor in accordance with the invention as it appears at rest, on starting of its rotation, and as encompassed by the turbine housing;

Like parts are indicated by similar characters of reference throughout the several views.

Figure 1:
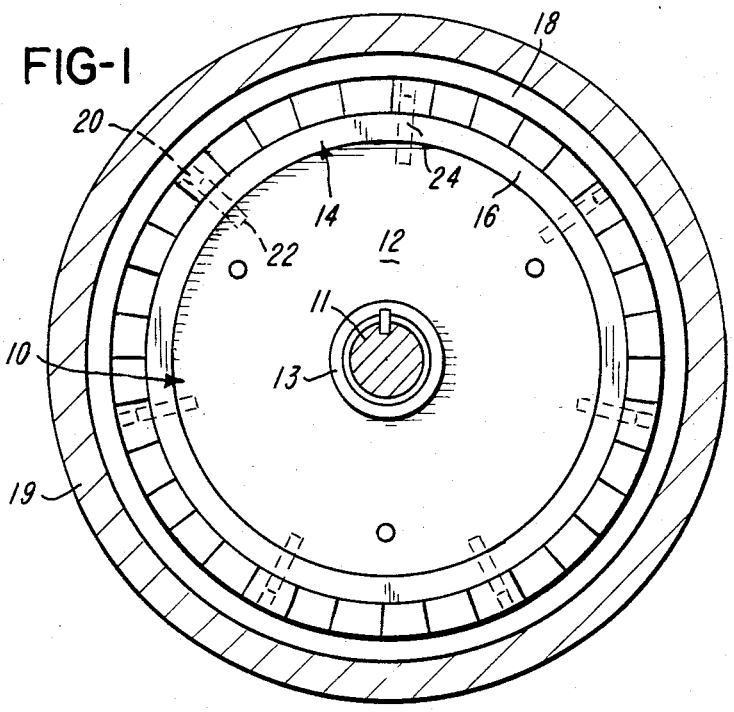
Figure 2:
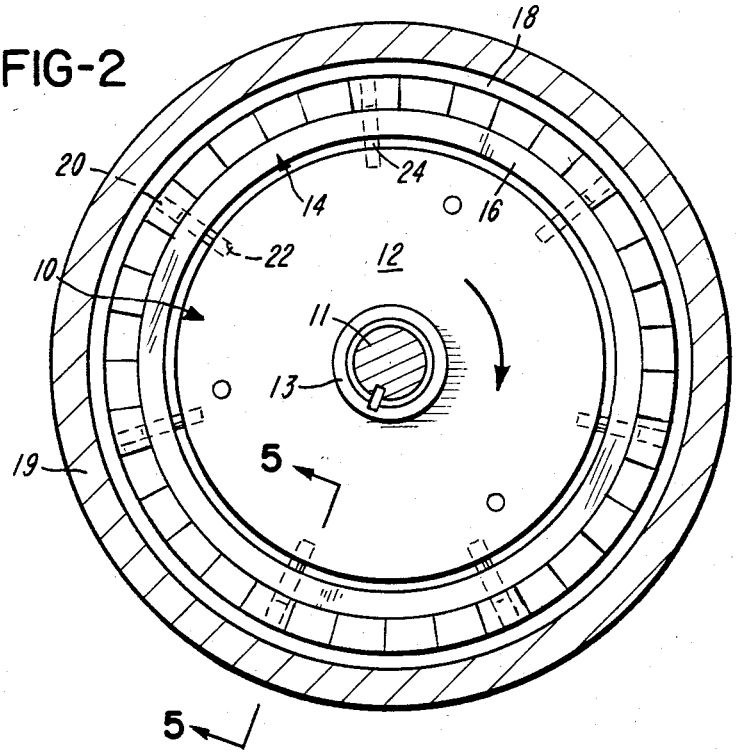
FIG. 2 is a view of the rotor within its housing at that point in time following its energization when it has reached its operating speed.
Figure 3:
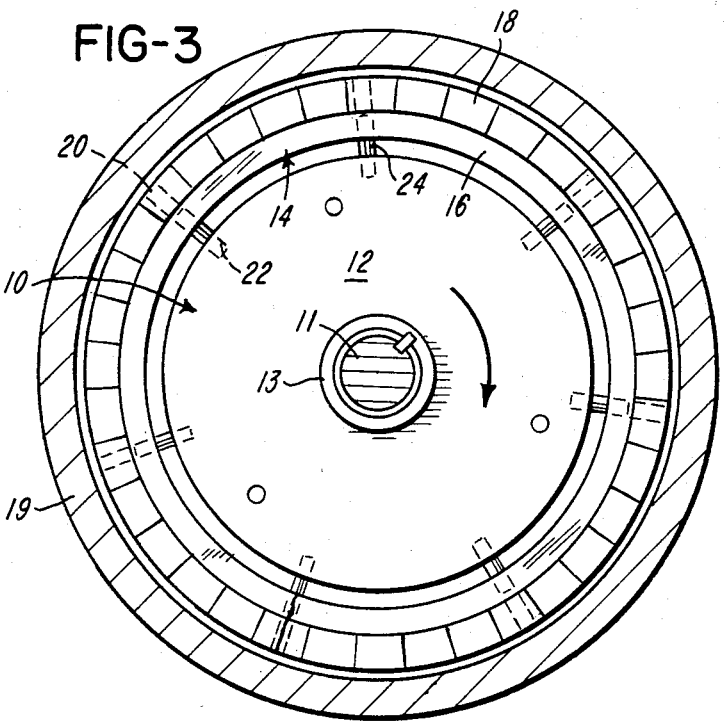
FIG. 3 illustrates the rotor of FIG. 1 at a point in time when the speed of its rotation has just passed its designed limit.
Figure 6:
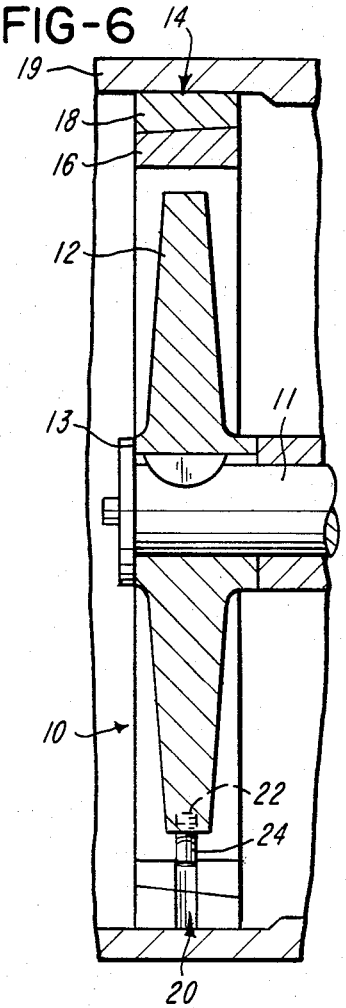
FIG. 6 is a sectional view taken on line 6—6 of FIG. 4.
Figure 4:
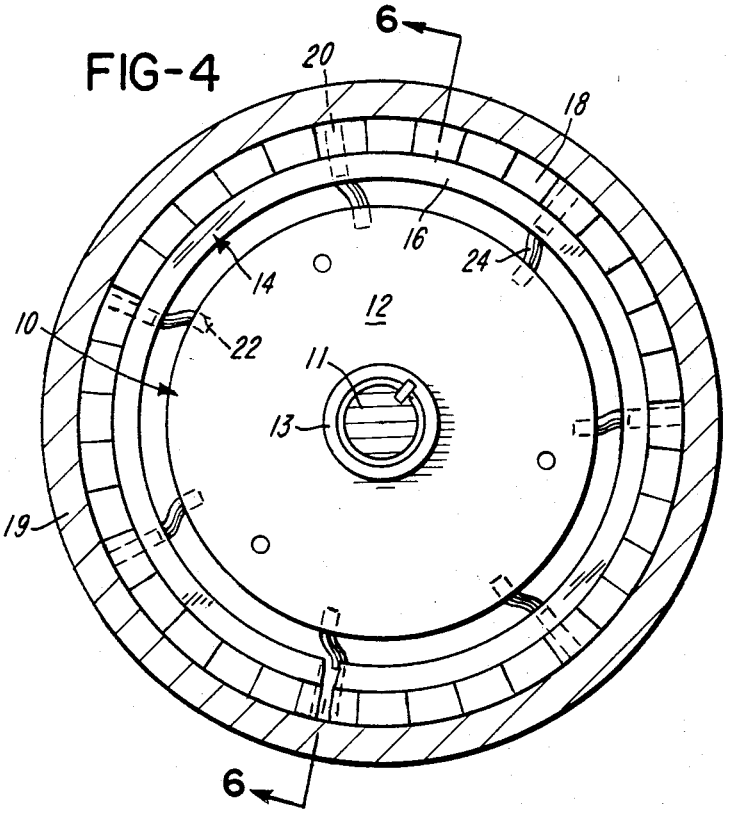
FIG. 4 is a view of the rotor wherein the excessive speed of its rotation has caused its outer ring-shaped part to separate at the point of a radial fracture, to radially expand into a braking engagement with its surrounding wall surface, and to separate from the rotor part which is radially inward thereof.
Figure 5:
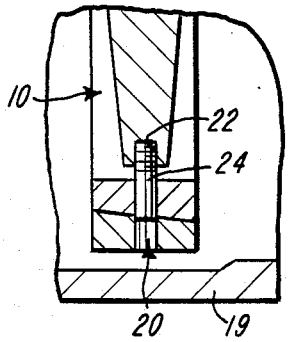
FIG. 5 is a view taken at line 5—5 of FIG. 2.

A rotor 10 per the present invention is originally a unitized structure. The embodiment illustrated comprises an annular disc 12 defining its radially inward part, fixed to and about the outer periphery of which is a ring-shaped part 14 which projects radially and outwardly therefrom. The ring-shaped part 14 comprises as its radially inward portion a hoop 16 which is mounted in fixed relation to the disc 12 by virtue of an interference fit to its radially outermost peripheral surface. As shown, the ring-shaped part 14 is completed by a series of turbine buckets 18 integrated with and projected peripherally of and radially outward from the radially outermost surface of the hoop 16. The disc 12 includes a hub portion 13 at its inner periphery which accommodates (FIG. 1), in an obvious manner, the fixing of the disc, and thereby the rotor 10, to, about and to project radially of a shaft 11, thereby to provide for the conjoint rotation thereof as and when required.

As schematically illustrated, the rotor 10 is shown as contained within and with its outer peripheral limit in adjacent but spaced relation to the inner surface of the housing 19 and mounted in driving relation to the shaft 11 to which it is keyed. To serve its intended function the rotor will be conventionally driven by impact of a fluid, such as air, under pressure on its buckets 18.

The equipment which is powered by the drive of the rotor 10 herein illustrated is neither shown nor described since in and of itself it forms no part of the present invention.

As seen in the drawings, the ring-shaped part 14 includes therein a series of radially oriented apertures 20 which are circumferentially and equidistantly spaced. In the application of the ring-shaped part 14 to and peripherally of the disc 12 to establish therebetween a fixed relation, the apertures 20 are respectively aligned with one of a series of radially oriented blind bores 22 formed in and opening from the outer peripheral surface of the disc 12. Once the parts 12 and 14 are fixed together and an alignment of the respective apertures 20 and bores 22 is achieved, a pin 24 is inserted in each of the apertures 20. The radially innermost end of each pin 24 is threadedly engaged with the peripheral wall surface of the aligned bore 22, which is tapped. As should be clear, the diameter of each bore 22 is slightly less than that of the aperture with which it aligns. Also, the length of each pin 24, as installed, provides that a major portion thereof lodges in and extends a substantial portion of the length of the related aperture 20. The diameter of that portion of each pin 24 outwardly of the bore in which it is applied is less than the diameter of the aperture 20. As will be seen, there is no direct connection or functional relation as between the ring structure 14 and the pins 24 until required.

Thus, given the above described structure and relation of its parts, as originally fabricated the embodiment of the invention herein illustrated is a unitary structure and usable as a turbine rotor. The connection between the ring-shaped part 14 and the disc 12 is suitably made in the first place to maintain a fixed relation as between these parts during an energization of the rotor and for a short period of time thereafter, until the speed of the rotor rotation has risen from "0" at the start to a preset level. This level is built into the rotor by the nature of the connection between the parts 14 and 12. In the example illustrated the connection is achieved by a predetermined interference fit, the effect of which is to pre-stress the ring structure 14 to good advantage. It should be understood that an interference fit is preferred since it decreases the range of cyclic stress to which the rotor is subjected in use. However, that this does not preclude the use of other means to connect the parts 12 and 14, as long as the relative positions thereof are fixed during the energization of the rotor and they produce equivalent results. With this built in feature, one avoids a sudden sharp relative rotative displacement as between the ring-shaped part 14 and the disc 12 when the rotor is energized. Absent this feature, particularly where the rotors are substantial as to their size and weight, and to the extent which would be determined by the nature of the material employed in fabrication of the rotor, the apertures 20 could be deformed and enlarged and produce an out of balance condition of the rotor with consequent chattering and early wear and stressing of the rotor parts, thereby to shorten their effective operating life.

Furthermore, the connection established as between the radially outward ring-shaped structure 14 and the disc 12 in the first instance is contrived to provide for a breaking away of the outer ring-shaped part 14 from the outer peripheral surface of the disc 12 at a point in time corresponding to the occurrence of the speed of rotation of the rotor, once energized, rising to a pre-set level which is above starting speed. However, this pre-set level must be limited so that in no case should it be so selected that the speed of rotation to which it corresponds is perceptibly higher than the prescribed operating speed of the rotor. It is preferred, in fact, that the breaking away of part 14 should be at a level of speed which is below its operating speed.

To summarize, as the rotor 10 is energized and the speed of its rotation first reaches the aforesaid pre-set level (substantially immediately after its energization in most cases) there is at this time a breaking away of the part 14 to free it from a direct connection with part 12. Consequently, a slight relative rotative movement occurs as between the parts 12 and 14, causing the part 14 to positively abut the pins 24 and thereby drive the disc 12 so it rotates conjointly therewith, about the central longitudinal axis of the rotor. As will be obvious, the power thus applied to the disc 12 is transmitted to the associated equipment through the shaft 11. Thereafter, and during the continuing operation of the turbine rotor, the ring-shaped part 14 will self adjust as to its diameter in correspondence with its speed of rotation and, of course, the resultingly developed centrifugal force. Its changing diameter will be accommodated by its movement along and in bearing relation to the pins 24. The part 14 is thus maintained in a fully balanced condition and in a substantially co-planar relation to the disc 12 as long as the speed of rotation of the rotor does not exceed the limits prescribed by its design.

The size, composition and weight of the part 14 will be made such that should the speed of rotation of the rotor reach a level beyond that prescribed as the limit thereof for its design, the rotor will fracture and/or have a separation in the location of an aperture 24 and in any event expand sharply and move outward on the pins 24 sufficiently to wedge against the inner wall surface of the housing 19. The result is an immediate braking of the then existing dangerous rotative speed of the rotor and in particular the ring 14. This insures against and prevents the occurrence of an uncontrolled speed and self-destruction of the rotor on rotor malfunction. Thus, the failure of the rotor will be benign, as far as the consequences are concerned.

As should be readily seen, the invention achieves the objectives first stated and provides not only safety and relatively quiet efficiency in the use of its embodiments, irrespective of their material, weight or size, but also a rotor the parts of which have greater endurance and a longer and more satisfactory operating life by reason of a substantial elimination of shock load and a better control and normalization of the stress experienced in the rotor operation. With respect to the most pertinent of the prior art, the incorporation of the features of the present invention are most significant in respect to the latter benefits.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus comprising a rotor, said rotor being a unitized structure including a radially outermost part and a part radially inward thereof, means defining a connection of said parts the form of which provides a relatively fixed relation of said parts on the energization and start up of said rotor and until the speed of its rotation reaches a preset level, said level not exceeding, perceptibly, the operating speed of said rotor, said parts and said connection being formed to provide a displacement of one of said parts relative the other as the speed of rotation of said rotor reaches said level and to maintain a displaced relation of said parts as long as the rotor speed remains at or is above said preset level and further means interrelating with said parts to effect and maintain a coupled relation of said parts during the period of their relative displacement, as long as the speed of rotation of said rotor does not exceed its designed limit.

2. Apparatus as in claim 1 characterized in that said connection between said parts is defined by an interference of portions of said parts which produce a pressured fit of one to the other, by means of which said radially outermost part is prestressed.

3. Apparatus as set forth in claim 2 wherein said outermost part has a ring shape and includes therein a plurality of circumferentially spaced openings, said inward part has in connection therewith pin shaped projections each of which is loosely fit within one of said openings in said outermost part, the cross section of said openings having a greater dimension than the cross section of said pin shaped projections which are applied therein and said pins serve as said further means which provide and maintain said coupled relation of said parts during any period of their displacement unless the speed of rotation of said rotor exceeds its designed limit.

4. Apparatus as in claim 1 wherein one of said parts has therein a plurality of openings and the other a plurality of pin shaped projections arranged to loosely position in said openings, said openings being larger in cross section than said pins, and said pins are rendered operative to maintain a coupled relation of said parts on the occurence and during the period of the relative displacement therebetween, as long as the rotor speed does not exceed the limit of its design.

5. Apparatus as in claim 3 wherein said ring is designed to have a substantially radial fracture and separation therein in the location of one of said openings to essentially nullify any effective drive as between said parts in the event said rotor speed exceeds the limit of its design.

6. Apparatus as in claim 1 wherein said preset level is between the starting speed of said rotor and its prescribed operating speed.

7. Apparatus as in claim 1 wherein said preset level is below the operating speed prescribed for said rotor.

8. Apparatus as in claim 3 wherein said outermost ring shaped part is formed to self adjust in correspondence with the speed of rotation of said rotor.

9. Apparatus as in claim 1 wherein said inward part includes a portion serving as a hub for said rotor, adapting it to be releasably secured in connection with a drive shaft, and said fixed connection of said parts positions said outermost part concentric with said hub portion of said rotor.

10. Apparatus as in claim 1 wherein said radially inward part has the configuration of a disc and said outermost part of said unitized structure is fixedly connected to and about the surface portion of said disc which defines its outer periphery.

11. Apparatus as in claim 3 characterized in that said parts are constructed and arranged to have a radial displacement of one of said parts relative the other on the occurence of said rotor speed being at or above said preset level and in that said further means interrelating said parts are constructed and arranged for a rotative movement of one of said parts relative the other to effect said coupled relation of said parts on the occurence of their relative displacement.

12. Apparatus as in claim 1 wherein said further means are constructed and arranged to provide guided movement of at least one of said parts relative the other during the period of displacement of said outermost part from said inward part.

13. Apparatus as in claim 1 including a housing or shield a portion of the inner wall surface of which positions in adjacent spaced relation to the outer periphery of said outermost part, said outermost part having a ring shape and being constructed to automatically adjust as to its size in response to and in correspondence with changes of applied centrifugal force during the period of the relative displacement of said parts and to fracture at one of a series of points provided circumferentially thereof to open and in said open condition brake against said inner surface of said shield or housing in response to a speed of rotation of said rotor in excess of that which is its designed limit.

14. Apparatus as in claim 13 wherein said ring shaped outermost part has turbine buckets connected to form an integrated part thereof which defines its radially outermost peripheral surface.

15. Apparatus as in claim 1 wherein said outermost part is a substantially ring shaped element including turbine buckets integrated therewith, forming a part and projected radially thereof, said element having therein a plurality of apertures spaced circumferentially thereof, said radially inward part including a portion thereof defining a hub for said rotor and mounting means defining pin-like radially oriented projections each extending through one of said apertures, the cross sectional dimension of the portions of said projections which extend through said apertures being less than that of said apertures through which they extend, said further means including said pin-like projections which, subsequent to the displacement of said outermost part and during the operation of said rotor within the designed safe limit of the speed of its rotation, function in the maintenance of a coupled relative driving relation between said parts.

16. Apparatus as in claim 15 wherein said ring shaped element is constructed to automatically adjust as to its diameter in correspondence with the speed of its rotation, said pin-like projections accommodated by said apertures through which they extend have a length to serve to maintain a coupled relation of said parts as long as the speed of rotation of said rotor does not exceed its designed safe limit, said ring shaped element being fabricated to split across one of said apertures when the speed of its rotation exceeds its designed limit and to expand as a result thereof to brake against the inner surface of the shield or housing which is normally maintained in an adjacent closely spaced relation to the radial limit of said rotor.

* * * * *